United States Patent [19]

Vandergrift

[11] 4,099,570

[45] Jul. 11, 1978

[54] OIL PRODUCTION PROCESSES AND APPARATUS

[76] Inventor: Donald Bruce Vandergrift, 264 Silverbrook Way N.W., Calgary Alberta, Canada

[21] Appl. No.: 763,331

[22] Filed: Jan. 28, 1977

[30] Foreign Application Priority Data

Apr. 9, 1976 [GB] United Kingdom ..... 14571/76

[51] Int. Cl.[2] ..... E21B 43/24

[52] U.S. Cl. ..... 166/303; 166/50; 166/62; 166/302

[58] Field of Search ..... 166/263, 302, 303, 306, 166/272, 50, 57, 62

[56] References Cited

U.S. PATENT DOCUMENTS

| | | | |
|---|---|---|---|
| 1,520,737 | 12/1924 | Wright | 166/50 X |
| 2,365,591 | 12/1944 | Ranney | 166/306 X |
| 2,786,660 | 3/1957 | Alleman | 299/6 X |
| 2,914,124 | 11/1959 | Ripley, Jr. | 166/57 |
| 3,017,168 | 1/1962 | Carr | 299/2 |
| 3,024,013 | 3/1962 | Rogers | 166/302 X |
| 3,338,306 | 8/1967 | Cook | 166/302 |
| 3,386,508 | 6/1968 | Bielstein et al. | 166/303 X |
| 3,986,557 | 10/1976 | Striegler et al. | 166/50 X |

FOREIGN PATENT DOCUMENTS

| | | | |
|---|---|---|---|
| 782,369 | 4/1968 | Canada | 166/303 |
| 590,859 | 1959 | Italy | 299/6 |

*Primary Examiner*—Stephen J. Novosad
*Assistant Examiner*—George A. Suchfield
*Attorney, Agent, or Firm*—Wofford, Felsman, Fails & Zobal

[57] ABSTRACT

A process and apparatus is described for use in the recovery of oil from natural oil-bearing formations such as tar sands by means of thermal energy causing the oil to gravity in the formation into an oil-receiving duct. Oil recovery in relation to installation and operating costs is improved by releasing heat into the formation at the site of the oil-receiving duct. For this purpose a composite heating and oil recovery string is used which is installed along the formation and comprises a tubular casing having oil-entry apertures and, internally of such casing, an oil-receiving duct and a passageway for the circulation of fluid heating medium.

9 Claims, 6 Drawing Figures

OIL PRODUCTION PROCESSES AND APPARATUS

This invention relates to an oil recovery string for use in the recovery of oil from natural oil-bearing formations. The invention also relates to oil recovery processes.

It is known to recover oil from natural oil-bearing formations with the aid of thermal energy supplied by a fluid heating medium. U.S. Pat. No. 3,386,508 describes a fluid-drive type recovery method wherein a well bore and a plurality of wells are drilled so that the wells intersect the well bore in the oil-bearing formation and a hot fluid is injected into the formation from the wells to cause viscous oil to flow into and accumulate in the well bore for recovery. The number and pattern of the drilling operations which this method requires make the production costs very high. The injection of fluid into the formation from the wells must over any given period of time be confined to a limited region along the wells so as to leave lengths of the wells free to receive lowered viscosity oil. Otherwise oil recovery is limited to that which flows directly into the central well bore.

Another type of recovery system employing thermal energy is described in U.S. Pat. No. 3,338,306 in which heating conduits extend along upper levels of the oil-bearing formation from a naturally exposed working surface of the formation or from a surface exposed by trenching, and heated fluid is circulated through these conduits to effect indirect heating of the oil in adjacent regions of the formation to a temperature such that the oil gravitates within the formation. As one method of recovering the heated oil the said United States Patent proposes the installation of a perforated pipe along the lower levels of the formation in a position where it will collect some of the oil as it reaches that level. In order to preserve a flow of oil through the perforations of the collecting pipe it is recommended that the pipe be installed in a drilled borehole of larger cross-section than the pipe, the reason being that the greater the space surrounding the pipe, the easier will be the collection of the gravitating oil. In order to maintain flow of oil into and along the collecting pipe this pipe is connected to pumps which pump the oil from the pipe to a surface recovery site. The preservation of a free space around the oil recovery pipe involves difficulties in practice when working unconsolidated formations such as tar sands. Therefore the oil recovery is liable to become seriously retarded in course of time. In addition it would be highly desirable to improve the economics of this type of recovery system by reducing installation costs and/or the energy consumption for a given rate of oil production.

It is an object of the invention to provide for the recovery of oil from oil-bearing formations, in particular unconsolidated tar sands, with improved efficiency and lower installation or operating costs.

A further object is to recover oil by means of an oil-recovery pipe with distribution of heat into the formation from the vicinity of such pipe.

A more particular object of the invention is an oil recovery string of composite form combining oil-recovery and heat distribution functions.

One important discovery underlying the invention is that when employing thermal energy to cause flow of oil within an oil-bearing formation into a collecting pipe, important advantages are achieved if heat is released into the formation at the site of the collecting pipe. In particular, favourable oil recovery rates can be more quickly achieved and long term recovery rates can be improved.

By providing an oil recovery string which serves both for oil collection and for heat distribution, the present invention enables these advantages to be realised and in addition makes an important contribution to reduction of costs by reducing the number of drilling or string driving operations required.

An oil recovery string in accordance with the present invention is characterised in that it comprises a tubular casing within which there is at least one internal passageway along which heated fluid medium (liquid or gas) for supplying thermal energy to a said formation can be passed, and at least one duct along which oil can flow along the string, said casing having oil entry apertures disposed at intervals therealong, which apertures are in communication with the interior of said duct.

The invention comprehends recovery strings which are formed to effect direct and/or indirect heating of the formation. In one type of string, it serves as a heat distributor from which heated fluid medium can be injected into the oil-bearing formation. In such apparatus, the string casing has fluid discharge orifices distributed therealong and houses interior fluid pipes leading to fluid discharge orifices in different portions of the length of the string.

In another type of string, which is the preferred type, the string serves as indirect heater, the fluid heating medium being isolated from the formation. In this type of apparatus, a fluid passageway within the string casing is defined at least in part by such casing and is open only at its ends so that it can form part of a closed circuit along which heated fluid medium can be circulated in heat exchange relationship with the casing. Such apparatus permits recovery of oil in its original form, i.e., without contamination by fluid heating medium.

Direct and indirect heating are not mutually exclusive. A string can have a fluid passageway through which heated fluid medium can be circulated, within the string, in heat exchange relationship with the string casing, and may have perforations via which a proportion of the fluid medium can escape into the formation.

The oil recovery string or strings may be formed in sections which are connected using jointing techniques known per se in the formation of conventional drilling strings.

The invention includes oil recovery installations incorporating one or more oil recovery strings as herein defined, as well as oil recovery processes wherein such installations are used. Such installations and processes can be applied to formations of any type of location but are likely to be particularly advantageous for producing oil from formations with an insufficient depth of overburden to permit oil to be driven from the formation by pressure. A very important example is tar sand reservoirs which are too deep or unsuitably located for surface mining techniques, but insufficiently deep for oil to be recovered by the known kinds of fluid injection technology wherein fluid is laterally injected into the formation from wellbores. There are known large area tar sand reservoirs with an overburden of from 150 to 500 feet which could be exploited by a process according to the invention. For working relatively shallow-lying formations it will generally be preferable to employ one or more strings according to the invention wherein the fluid heating medium is kept isolated from the formation, but if fluid injection from a string or strings located at the bottom of the formation is practised, the injection can be limited so as to avoid any tendency for the injection to break down the overburden.

Depending on the geology of the oil-bearing formation and other factors, the or each oil recovery string can extend downwardly into the oil-bearing formation from the surface or from a well or a trench or other excavated working site. In certain installations according to the invention the oil recovery string or strings is or are laid at an upward inclination from an oil collecting site where there is an oil sump so that flow of oil along the string or strings and into such sump occurs by or with the assistance of gravity.

Heat additional to that which derives from the heated fluid medium fed along the oil recovery string or strings can be supplied to the oil-bearing formation at other places in any desired manner, e.g. by fluid injection or by electrical heating means.

A method of oil recovery according to the invention can be carried out in conjunction with other oil recovery techniques if so desired. For example the flow of oil into the recovery string or strings can be assisted by fire flooding or by solution gas drive if in any given case that technique is compatible with environmental considerations.

Reference is now made to the accompanying drawings in which certain embodiments of the invention, selected by way of example, are illustrated. In these drawings.

Figure 2A:
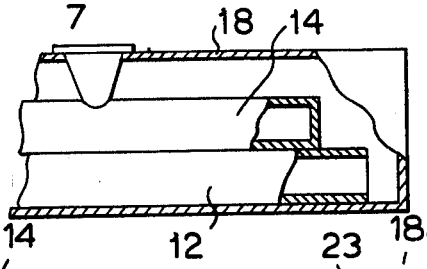
FIG. 2 is a partly sectioned longitudinal elevation of part of an oil recovery string used in that process.
Figure 2:
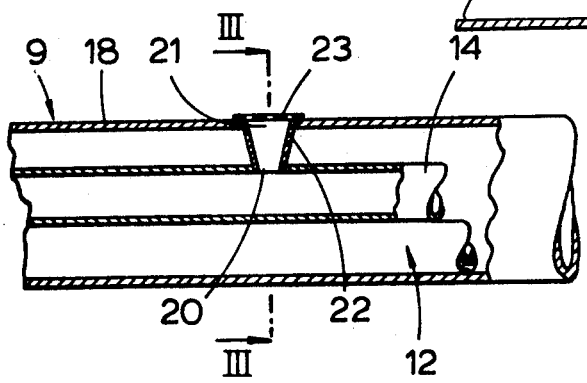
Figure 3:
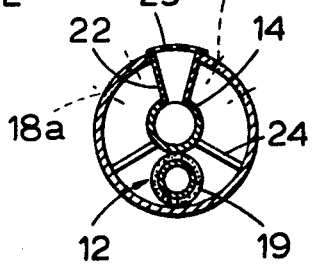
Figure 4:
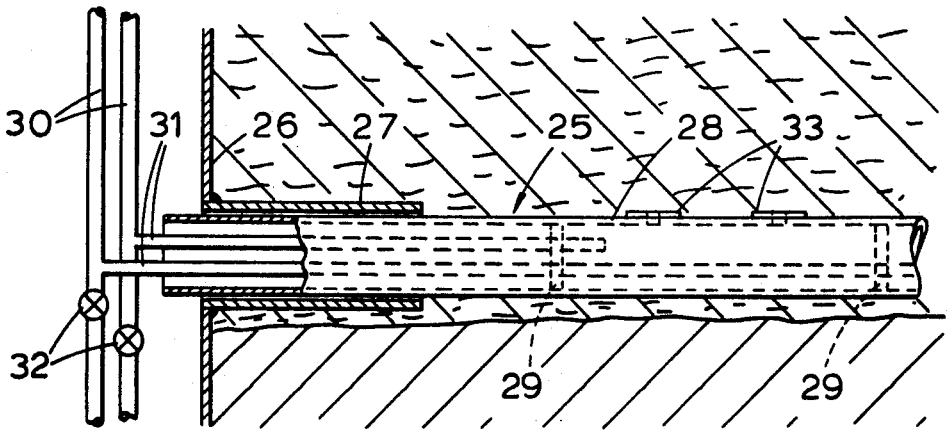
Figure 5:
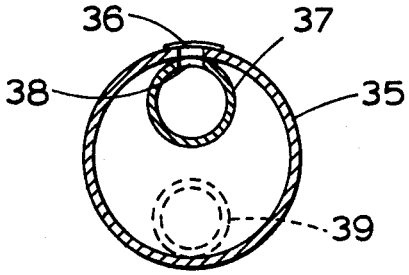

FIG. 2*a* shows the construction of that string at its distal end;

FIG. 3 is a transverse cross-section of the recovery string on line III—III in FIG. 2;

FIG. 4 is a detail of part of an installation for carrying out another process according to the invention;

FIG. 5 is a cross-section of another form of oil recovery string according to the invention.

An example of a process according to the invention will firstly be described with reference to FIG. 1. In this FIG., 1 is a tar or bituminous sand formation which overlies a subrock stratum 2 and is overlaid by an overburden 3 of between 150 and 500 feet in depth.

A vertical shaft 4 is driven from the surface to a level beneath the tar sand formation 1 and at the bottom of the shaft a cofferdam 5 is built. Within this cofferdam is a raised work floor 6 beneath which is an oil sump for receiving recovered oil 7. Secured to the wall of the cofferdam is a tubular guide 8 which may for example be about 10 feet in length. This guide serves to guide the direction which an oil recovery string 9 follows as the string, which is formed of successively conjoined sections, is advanced from the cofferdam. The guide is disposed so as to direct the recovery string along the bottom of the oil-bearing formation 1, supported by the subrock 2. The guide may for example have a radially inwardly projecting lug or tongue and the sections of the outer casing of the recovery string may have a receptive helical groove so that a twisting motion is imparted to the recovery string as it advances.

In suitable geological structures, rotary jet or nonrotary boring may be practiced for installing the recovery string, using a jet head fed with water via a tube passing along the interior of the casing of the recovery string and that tube may subsequently remain in place and may serve some other purpose, e.g., to convey cooled heating medium back to a heat generator. If the oil bearing formation is sufficiently consolidated, it can be bored by means of an auger.

Figure 1:
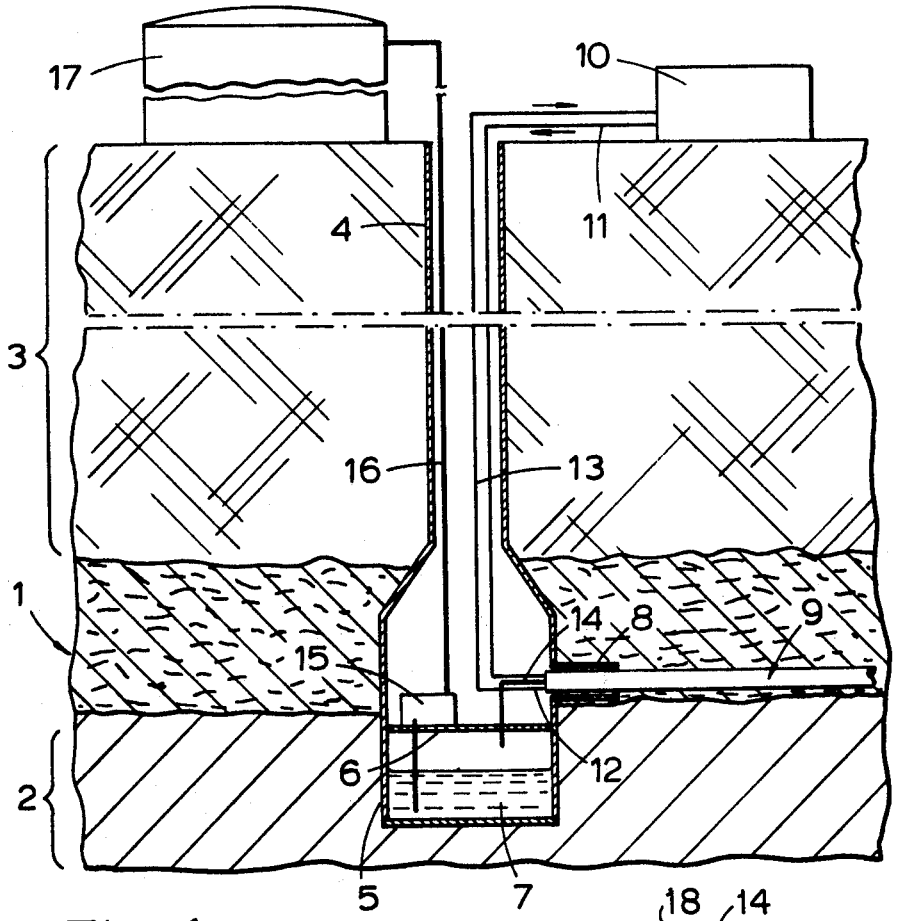
FIG. 1 is a vertical section through part of an oil reservior production plant for producing oil by a process according to the invention.

In FIG. 1 only one oil recovery string is shown. There may and will normally be a plurality of such recovery strings radiating from the shaft so that oil can be simultaneously recovered from a number of different sectors around the shaft. When working a thick oil-bearing formation, one or more strings according to the invention may be provided at different levels of the formation. The jointed sections of the or each string may be of any length suitable for handling and transportation. The total installed length of each string may be as much as 500 feet or even 1000 feet or more, depending on circumstances pertaining to the geology of the formation and the available plant installation and oil receiving and storage facilities.

Steam is pumped from a steam generating plant 10 along a pipe 11 and into the casing of the recovery string 9. On reaching the distal end of the string (which end is closed), this heating medium, now relatively cool, flows back along a return tube 12 which extends along the interior of the casing, and then into an up pipe 13 leading back to the generator 10. Viscous crude in a zone of the oil-bearing formation 1 is heated by transfer from the heated string casing sufficiently to cause that oil to flow downwardly under gravity. A large proportion of this oil flows into the string and into an internal oil-receiving pipe 14. The recovery string 9 is slightly upwardly inclined to the horizontal from its source to its distal end. Consequently oil entering the pipe 14 flows therealong under gravity back to the shaft and discharges into the cofferdam sump. From this sump the oil 7 is pumped by a pump 15 along an oil delivery pipe 16 into an oil storage reservoir 17. Of course the flow of oil along the string could be achieved or assisted by a pump if required.

Due to the heating of the recovery string, oil recovery commences soon after circulation of the steam through the string is initiated. As a volume of the oil-bearing formation becomes heated by heat transfer from the string, gravitating oil tends to flow to the zone of highest temperature, i.e. to the site of the recovery string. Consequently the string receives oil from an area of the formation which is more extensive than the vertically projected area of the string. The oil recovery rate is therefore favourably high in relation to the heat energy consumed.

The construction of the recovery line 9 is shown in FIGS. 2, 2*a* and 3. It comprises a heat conducting casing 18 made of steel. Within this casing 18 there are the tube 12 which provides the return reach of the passageway along which the fluid heating medium is circulated within the string, and the oil-receiving pipe 14 which have already been referred to. The steam pumped into the string from the feeder pipe 11 flows along the interior of the casing, externally of the tube 12 and the pipe 14, and at the closed distal end of the string (shown in FIG. 2*a*) the steam enters the open end of the return tube 12 via which the steam flows back along the string to the up pipe 13. The fluid return tube 12 has an external thermally insulating cladding 19 to prevent significant heat absorption from the steam which is pumped into the string casing from the steam feeder pipe 11. The oil-receiving pipe 14, which is closed at its distal end (FIG. 2*a*), has oil-entry ports 20 at intervals therealong, at least in the top portion of this pipe wall. The string casing 18 has slightly larger oil-entry ports 21 opposite the ports 20 in the oil pipe 14. Funnel portions 22 are connected to the pipe 14 to conduct oil to its oil entry ports 20 and the wider ends of such funnel portions are secured to the casing at the locations of its oil-entry ports 21 so that oil from the oil-bearing formation flows via said funnel portions into the oil-receiving pipe 14. The oil-entry ports 21 in the casing 18 are fitted with screens 23 for retaining sand particles. These screens are shaped with convexly curved upper surfaces so that retained particles tend to be washed off the screen surfaces. In a well-consolidated formation, screens could be dispensed with. As appears from FIG. 3, the oil pipe 14 is supported by radial arms 24 secured to the casing 18. The fluid return tube 12 may be secured also to the casing, or may be secured to the oil pipe 14 so that the casing 18 and the internal tube and pipe form a unitary structure.

In a variant form of the oil recovery plant, a steam switch valve means is provided so that, at any time or times during production, some of the steam supply can be switched to the oil pipe 14 to cause steam to discharge into the oil-bearing formation through the screens 23. This is useful for clearing the screens and boost-heating the formation.

The jointed sections of the oil recovery string may for example have a length of about 30 feet. The diameters of the casing 18, the internal fluid return tube and the oil-pipe will be selected depending on circumstances. As an example the casing may have a diameter of from 9 inches to 14 inches. The diameters of the fluid return tube and oil pipe must be sufficient for the required throughput capacity of cooled heating medium and recovered oil but must leave sufficient free space within the casing for the passage of steam at a volume rate appropriate to the required heat output from the recovery line.

In a modification of the process described with reference to FIGS. 1 to 3, the casing 18 is provided with perforations such as perforation 18*a* shown in dotted line in FIG. 3 to allow a proportion of the steam or other fluid heating medium to escape into the oil bearing formation.

As an example of a jointing system for the successive recovery string sections, the casing sections can be joined by welding and the lengths of the oil pipe and fluid return tube belonging to the different string sections can be formed for spigot and socket type connection, the spigot-forming end of one length having fitted sealing or packing rings which seal against the inner surfaces of the socket-forming end of the neighbouring length. This type of joint is well known to those conversant with oil recovery technology.

As an indication of the efficacy of plant as represented in FIGS. 1 to 3, if steam is circulated through the or each oil-recovery string at a temperature and flow rate corresponding to a heat input of between 500 and 1000 BTU/hr per square foot of the string casing surface then, depending on the composition of the oil reservoir, the temperature of the oil-bearing sand at regions from 6 to 10 feet from the string can be raised sufficiently to induce oil flow from such regions within a period of one year. However the energy input can be substantially outside this range. The optimum values of the various parameters such as heat input rate, number of strings etc. can be determined from pilot projects and calculations for a given location.

It is not essential to provide a working shaft such as 4 in FIG. 1. One or more small diameter wells may be drilled which communicate with the recovery string(s) and which is or are associated with means whereby the circulation of steam or other heating fluid through such string(s) can take place via such well(s). Oil can be pumped to the surface via one or more such wells or from a different location. For example a pattern of vertical wells, mutually spaced e.g. by 40 to 60 feet from each other could be linked by a system of recovery strings according to the invention each extending from one well to another.

FIG. 4 shows part of another oil-recovery string according to the invention. This recovery line 25, extends along the bottom or lower region of an oil-bearing formation from a shaft 26 fitted with a line guide 27 similar to guide 8 in FIG. 1. In the FIG. 4 embodiment the recovery string comprises a tubular casing 28 which is internally divided by partitions 29 into successive compartments. Vertical steam pipes 30 extend from a steam generator at the surface down to an oil sump at the bottom of the shaft and branch pipes such as 31 extend from these vertical pipes to the different interior compartments of the casing 28. The vertical steam pipes are fitted with valves such as 32 for controlling steam flow. In each portion of its length corresponding with one of the said interior compartments the casing 28 has at least one peripheral port such as 33 opening upwardly into the oil-bearing formation. The said ports are if necessary fitted with sand screens.

Steam under pressure is injected via the branch pipes into the internal compartments of the casing 28 so as to discharge upwardly from these compartments through the sand screens. The pumping of steam from each compartment occurs intermittently. For example, steam may be pumped from any given compartment or any given group of compartments for a period of one or more days or even a week or more, to be followed by pumping of steam from another compartment or group of compartments. When steam delivery to certain compartments is terminated, the corresponding valves 32 are opened. Oil which has been heated during the steam delivery from such compartments can now drain into such compartments via the screened ports 33. Once such compartments contain liquid up to a certain level, oil entering the compartments commences to discharge via the associated pipes 31 into the connected vertical pipes 30 along which the oil drains to the sump. To permit such discharge of oil, the conduit 28 is laid at a slight upward inclination from the shaft. Alternatively oil entering the compartments of the conduit can be drawn off by pumps.

By virtue of the division of the string casing into compartments, which compartments or groups of which compartments are associated with independent supply pipes for heated fluid a favourable heat distribution along the string can be ensured. If steam is merely fed into a perforated pipe the steam tends to escape via the shortest route and the heat distribution in the formation would be poor.

FIG. 5 shows a further form of oil recovery string. The string sections each comprise a casing 35 having oil-entry ports 36. Within the casing there is an oil-receiving pipe 37 having oil-entry ports 38 and the casing 35 and pipe 37 are secured together, e.g. by welding, so that the ports 36 and 38 are in sealed communication. Steam or other heated fluid medium can be supplied along the string between the oil-receiving pipe 37 and the casing so as to heat the casing and the oil-receiving pipe. The string can for example be installed between two shafts with flow of the heating medium from one shaft to the other. If required a tube 39 may be provided within the casing so that return flow of heating medium can take place within the string, through this tube.

An oil recovery string according to my invention could be used in processes other than those hereinbefore described. For example, such a string, preferably fitted with screening means for retaining solid particles above a certain size, can be used in oil recovery by installing the string depthwise of the oil-bearing formation, e.g. as part of a drilling pipe or string driven down to the formation from the surface. It may be possible to dispense with a shaft. A plurality of such strings could be driven at a given production point. Depending on the form of the string, heating may take place by injection of hot fluid medium from the string and/or by internal circulation of steam or other hot fluid medium within the string.

Having thus described the invention it will be understood that such description has been given by way of illustration and not by way of limitation. Numerous modifications, additions and subtractions may be made to the illustrated embodiments without departing from the spirit or scope of the invention.

I claim:

1. An oil recovery string for use in recovering oil from a natural oil-bearing formation with the aid of thermal energy supplied by a fluid-heating medium, said string comprising a tubular heat-conducting casing having oil entry apertures disposed at intervals therealong, an oil-receiving pipe located within said casing and having peripheral openings in sealed communication with said oil-receiving apertures in the casing, and wherein between said casing and said oil-receiving pipe there is a passageway along which heated fluid medium can be circulated in heat-exchange relationship with the casing.

2. An oil recovery string according to claim 1, wherein the string is formed so that the whole or substantially the whole of the interior surface of said casing is exposed to heated fluid when this is circulated along said passageway.

3. An oil recovery string according to claim 1, wherein said oil-receiving pipe is disposed so that its axis is substantially centrally located within the cross-section of said casing, wherein there is a tube extending along said string, between said oil-receiving pipe and the casing, and wherein the interior of said tube and the free space which is external to said tube and is between the oil-receiving pipe and the casing constitute reaches of a said passageway along which heated fluid medium can be circulated within the string.

4. A process for recovery of oil from a natural oil-bearing formation utilising thermal energy supplied by a fluid heating meadium to cause or accelerate flow of oil from the formation into an oil recovery duct, with the improvement that in a direction along the formation there is installed at least one composite heating and oil recovery string having a heat conducting casing within which there is at least one passageway for conducting fluid heating medium along the string in heat exchange relationship with such casing, and within which casing there is also at least one duct for conducting oil along the string, the said casing having peripheral oil entry apertures at intervals therealong (via) which apertures are in sealed communication with (the) said oil-receiving duct located within said casing, (is in communication with the formation,) and fluid heating medium is (circulated) forced along said heating passageway to heat a volume of the oil-bearing formation by heat transfer from the string so that oil is caused to gravitate from the formation into said oil-receiving duct via said oil entry apertures.

5. A process according to claim 4, wherein said string extends along the formation at an inclination so that oil entering said oil-receiving duct flows therealong under gravity.

6. A process according to claim 4, wherein within said casing there is also a return tube for the fluid heating medium and the fluid heating medium is forced along said passageway in contact with said casing, from one end of said string to the other end thereof, at which other end said fluid heating medium enters said return tube and then flows along that tube back to said one end of the string.

7. A process according to claim 4, wherein the opposed ends of said casing are connected into a closed circuit along which the fluid heating medium is circulated.

8. A process for recovery of oil from a natural oil-bearing formation utilizing thermal energy supplied by a fluid heating medium to cause or accelerate flow of oil from the formation into an oil recovery duct, with the improvement that in a direction along the formation there is installed at least one composite heating and oil recovery string comprising a tubular casing having ports at intervals therealong via which the interior of the casing is in communication with the formation, and comprising a plurality of fluid conducting pipes which extend along the interior of said casing and are in communication with ports in different portions of the length of the string, and at intervals of time fluid heating medium is forced along said pipes and into said formation via said ports to heat a volume of the oil-bearing formation so that oil is caused to gravitate from the formation into said oil-receiving duct via said ports.

9. An oil recovery string for use in recovering oil from a natural oil-bearing formation with the aid of thermal energy supplied by a fluid heating medium, said string comprising a tubular casing adapted to be laid in a direction along an oil-bearing formation, said casing having ports at intervals therealong via which oil gravitating from regions of the formation above the string can enter said casing, and having partitioning means subdividing the interior of the casing into different compartments distributed along the casing, and a plurality of fluid conducting pipes which extend along the interior of said casing and have fluid discharge ends thereof disposed in different said compartments to permit heating fluid to be intermittently discharged from ports in different portions of the length of the casing, for heating oil in said regions of the formation, by forcing such medium intermittently through said pipes.

* * * * *